US005974768A

United States Patent [19]

Schölzke et al.

[11] Patent Number: 5,974,768

[45] Date of Patent: Nov. 2, 1999

[54] DEVICE FOR PACKAGING A MATERIAL WEB ROLL WITH A PACKAGING SHEET

[75] Inventors: Volker Schölzke, Krefeld; Jakob Hannen, Willich; Jozef-Franc Zajec, Velden; Hans-Josef Peters, Kleve; Udo Ticheloven, Wesel; Frank Rostek, Meerbusch, all of Germany

[73] Assignee: Woith Sulzer Finishing GmbH, Krefeld, Germany

[21] Appl. No.: 08/991,634

[22] Filed: Dec. 16, 1997

[30] Foreign Application Priority Data

Dec. 17, 1996 [DE] Germany ..... 196 52 449

[51] Int. Cl.[6] ..... B65B 11/56

[52] U.S. Cl. ..... 53/399; 53/587; 53/214; 53/383.1

[58] Field of Search ..... 53/214, 373.3, 53/377.4, 383.1, 465, 399, 587, 211, 215

[56] References Cited

U.S. PATENT DOCUMENTS

| | | | |
|---|---|---|---|
| 2,638,725 | 5/1953 | Hurter et al. . | |
| 2,872,767 | 2/1959 | Clem . | |
| 2,893,191 | 7/1959 | Lancaster | 53/214 X |
| 3,443,353 | 5/1969 | Di Vecchio | 53/377.4 X |
| 3,494,095 | 2/1970 | Valvano | 53/214 X |

FOREIGN PATENT DOCUMENTS

| | | |
|---|---|---|
| 1009556 | 5/1957 | Germany . |
| 195 35 746 | 4/1997 | Germany . |

*Primary Examiner*—Linda Johnson
*Attorney, Agent, or Firm*—Greenblum & Bernstein, P.L.C.

[57] ABSTRACT

Device and method for packaging a material web roll, having a longitudinal axis, with a packaging sheet. The device includes a packaging sheet dispenser that dispenses the packaging sheet such that a lateral width of the packaging sheet forms an acute angle to the longitudinal axis. The device also includes a glue application station having a first glue application device composed of an operational gluing device and a second glue application device composed as an end gluing device. The method includes feeding the packaging sheet through a gluing station, applying at least one glue bead parallel to an edge of the packaging sheet, spraying glue onto at least a portion of the packaging sheet, and guiding the packaging sheet onto an outer surface of the material web roll.

27 Claims, 1 Drawing Sheet

Fig.2
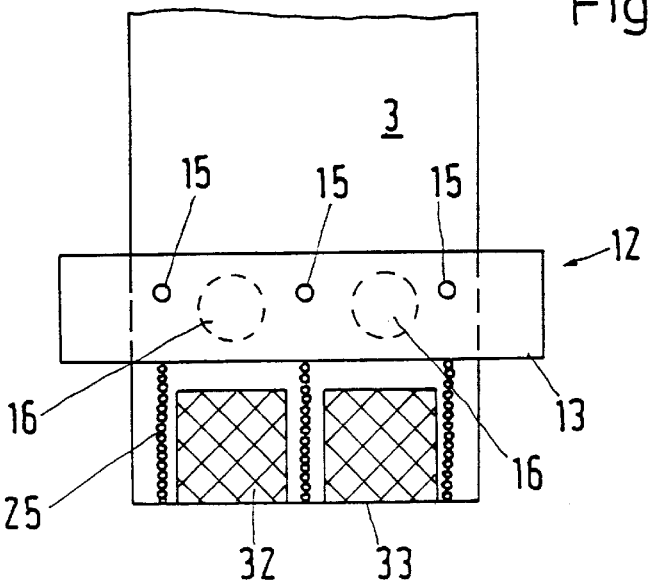
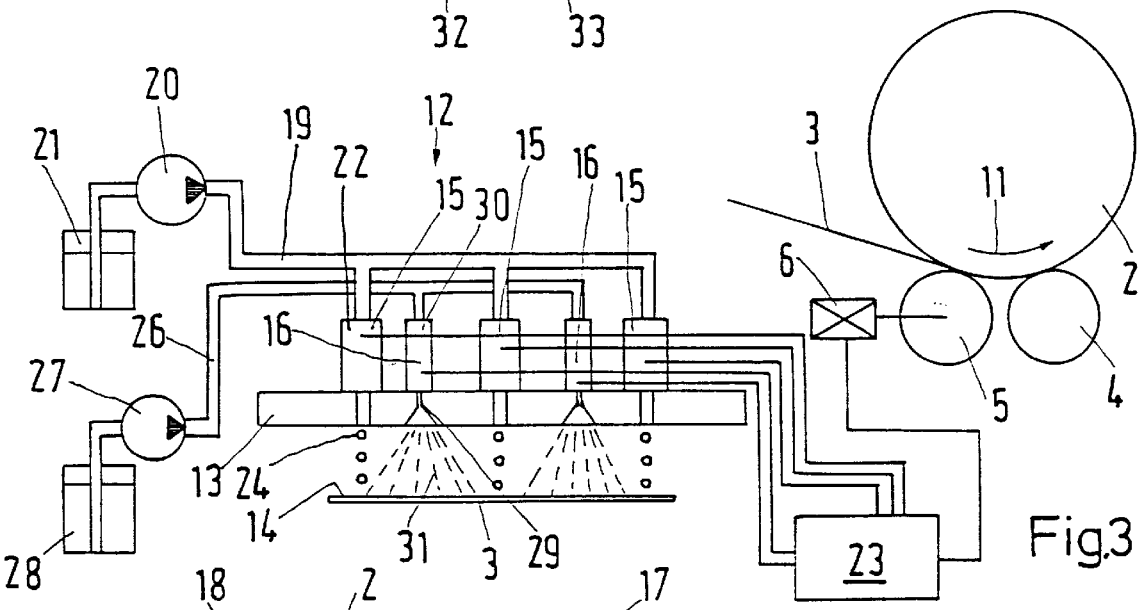
Fig.3
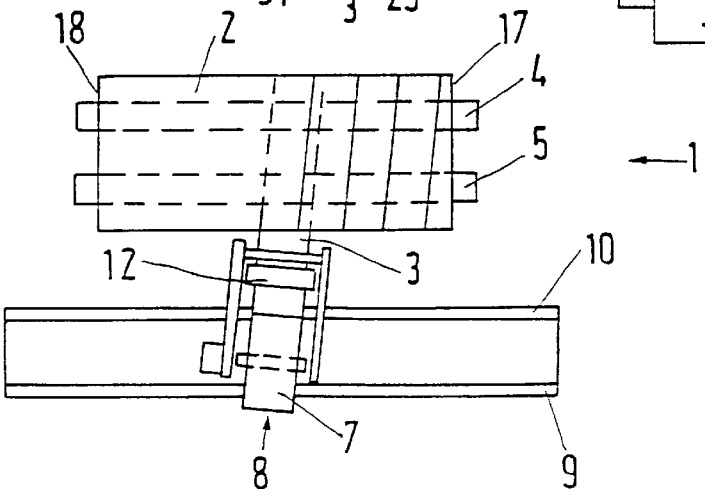
Fig.1

DEVICE FOR PACKAGING A MATERIAL WEB ROLL WITH A PACKAGING SHEET

CROSS-REFERENCE TO RELATED APPLICATION

The present application claims priority under 35 U.S.C. § 119 of German Patent Application No. 196 52 449.0 filed Dec. 17, 1996, the disclosure of which is expressly incorporated by reference herein in its entirety.

BACKGROUND OF THE INVENTION

1. Field of the Invention

The present invention relates to a device for packaging a material web roll with a packaging sheet having a packaging sheet dispenser and a glue application station. The packaging sheet is dispensed from a packaging sheet dispenser at an angle, e.g. an acute angle with respect to a lateral direction of the material web roll axis.

2. Discussion of Background Information

Devices similar in general to the above-noted device is known in the prior art, e.g., in DE 195 35 746. As is known, material web rolls requiring packaging have a considerable size, e.g., their diameter is generally in the region between approximately 500 to 2500 mm and their width is generally in the region between approximately 500 to 3800 mm or more. Material web rolls of this type are produced, e.g., in the production of paper or textiles. In order to prepare these material web rolls for transport rolls from their place of production, e.g., from the paper factory, to a production site, e.g., to a printing shop, the material web rolls must be wrapped with a packaging sheet for protection. The packaging sheet provides a mechanical protection against damages, and also should reduce to a minimum the influence of certain environmental variables, e.g., humidity.

Until now, material web rolls have been wrapped in such a way that a multitude of supply rolls for packaging sheets had to be readily available. That is, depending on the width of material web rolls to be wrapped, a supply roll of a corresponding width had to be stored for use. Further, the packaging sheets on the supply roll had to be of adequate width so that, after wrapping the material web roll, an axial projecting length, e.g., between 100 to 250 mm, remained to wrap the end faces of the material web roll.

Since, depending on demands, a paper factory must produce paper rolls having extremely variable widths, a correspondingly large number of supply rolls with packaging sheets must be readily available. This, however, is not an economical solution. The wider the packaging rolls become, the more expensive they are and the more difficult they are to handle.

It has been found that if the packaging sheet dispenser is not aligned parallel to the material web roll, i.e., to provide a purely circumferential wrapping, but is aligned at an angle to the material web roll, i.e., to provide a helical form of wrapping when the packaging sheet wraps around the material web roll, a single packaging sheet width is practically able to serve all widths of material web rolls.

This produces a high degree of economy in supplying packaging sheets, easier handling of packaging sheets due to lower weight of the supply rolls used for the packaging sheets, and a higher degree of flexibility in packaging the material web rolls. Thus, irrespective of the packaging sheet width, all material web rolls can be wrapped at a single station.

A disadvantage of the above-noted procedure is that more time is required to wrap a material web roll, and the amount of time required increases with the axial length of the material web roll.

SUMMARY OF THE INVENTION

In view of the foregoing, the present invention provides a device and method to reduce packaging times to as short as possible.

The present invention provides a device of the type generally described above that also includes a glue application station having a first glue application device acting as an operational gluing device and a second glue application device acting as an end gluing device. The terms operational gluing device and end gluing device are used merely as contractions and for convenience. Their specific tasks and functions will explained in the following description.

In order to maintain short packaging times, the speed of packaging, i.e., the speed at which the material sheet is rotated after the packaging sheet is brought into contact and adhered to the material web roll, may be increased. While increasing the wrapping speed has only an appreciable effect, when it is combined with maintaining short acceleration times, the material web roll with the adherent packaging sheet is accelerated as much as possible. Since the packaging sheet is glued to the material web roll, a severely stressed glue joint is provided. This stress may occur, in particular, at a beginning of the wrapping process when the packaging sheet does not yet adhere to the material web roll by other measures, e.g., by partially covering subsequent layers of packaging sheets during the helical rolling of the packaging sheet. Further, if the wrapping (packaging) procedure must be performed rapidly, very little time is available for making the glue joint. If the packaging sheet dispenser is arranged laterally to the material web roll, which is advantageous for purposes of handling, the packaging sheet is threaded between the material web roll and a support (or carrier) roll rotatably supporting the material web roll. As soon as the packaging sheet passes the first nip, e.g., between the material web roll and the support roll, the sheet must adhere to the material web roll with a firmness or adhesive force sufficient to prevent it from loosening. Further, the packaging sheet can be pressed in by a second nip formed between the material web roll and a second support roll. However, upon leaving the second nip, the glued joint must "hold." While there are glues which provide the required adhesive force after just a short time, these glues are relatively expensive. Thus, using such glues would render this type of packaging somewhat uneconomical. Other glues, which provide the necessary adhesive force after a certain period, are less expensive. However, there is a risk that they would not effect the starting "jolt," i.e., could not produce the required adhesive force of the packaging sheet on the material web roll. In this case, the beginning of the packaging sheet might become loosened from the material web roll, so that a satisfactory formation of a helical wrapping could not be provided.

Accordingly, the present invention provides two glue application stations. As noted above, one of the glue application stations, e.g., the first glue application device, may be referred to an "operational gluing device," in which glue, necessary and adequate for the development and gluing of the packaging along the axial length of the material web roll, is applied to the packaging sheet. This can be a relatively cost-effective adhesive, e.g., water glass glue. However, the glue requires a certain time to achieve the necessary (and desired) adhesive force. Thus, the operational gluing device alone would be inadequate to provide the necessary glued joint at the beginning of the packaging process, if the packaging sheet is to be attached to the material web roll. Therefore, the present invention also provides the end gluing device. The end gluing device provides the packaging sheet with an application of a fast-acting adhesive. For this purpose, glues of all types, even those having other disadvantages, such as higher cost or greater risk of contamination, may be utilized because the application of these glues is limited to the beginning of the packaging sheet and, if necessary, to the end of the packaging sheet. Since the beginning and end of the packaging sheet are arranged at the two axial ends of the material web roll, the second glue application device, as noted above, may be referred to as an "end gluing device." The advantages of the two operational gluing devices are that, when combined, the disadvantages of the respective individual operational gluing devices are reduced to the extent that they are, particularly from an economic standpoint, still justifiable.

A preferred embodiment of the present invention provides that the operational gluing device produces at least two glue beads that run substantially parallel to the edge of the packaging sheet. The term "glue beads" is understood to refer to an approximately line-shaped application of glue, which, under certain conditions, may also be a detached line. The glue beads ensure that the packaging sheet is continuously and securely glued onto the circumference of the material web roll or onto the overlap of the packaging sheet from a previously attached layer of the packaging sheet. In this manner, the packaging is firmly attached along the axial length of the material web roll, thus, providing the desired protection for the material web roll as if it were wrapped with a packaging sheet having a width corresponding with that of the roll. However, in the wrapping of the present invention, the helical line makes a better visual impression when utilized with longer material web rolls. Of course, the wider the packaging sheets become, the more difficult it is to lay them on the circumference of the material web roll without wrinkling.

It is advantageous if the dispensing of glue by the operational gluing device is controllable as a function of the speed of the packaging sheet. As described above, high wrapping speeds, e.g., 300 m/min, can be realized if utilized with correspondingly short acceleration times. However, extreme speeds may lead to a problem of glue application. For example, if the glue application, or the amount of glue applied per unit of time, is applied in accordance with the high speeds to achieve a reliable glued joint over the length of the material web roll, an undesired excess of glue may be applied at the beginning and end of the packaging sheet when the material web roll rotates at a reduced speed. This excess glue may lead to contamination when the glue oozes out. However, if the glue application is applied in relation to the reduced speed at the beginning and at the end, the amount of glue applied may not be adequate to produce the desired quality of packaging the axial length of the material web roll. The problem can be avoided by controlling the dispensing or application of the glue as a function of speed. That is, at the beginning and at the end of the packaging when the material web roll rotates at a lower speed, whereby the packaging sheet rotates at a lower speed, little glue is applied. As the speed increases, more glue is applied. In this manner, the present invention ensure that the application of glue per unit of length of the packaging sheet remains substantially constant. While minor fluctuations are sometimes unavoidable, the present invention provides that the application of glue is adequate if it remains within a range of, e.g., approximately ±15% of a given value, irrespective of speed.

The operational gluing device is preferably supplied with clock pulses and dispenses glue in the form of drops. The manner of dispensing glue is particularly easy to control. The glue may be supplied, e.g., from a pressurized glue supply, and the operational gluing device may include a dispenser opening that is only periodically released to enable glue to emerge through the dispenser opening. If, for example, the device utilizes a clock pulse for periodically opening the operational gluing device, the dispensing of glue may be determined according to a timing ratio, i.e., the relationship of the opening time to the cycle duration. This type of clocking requires considerably less expenditure than the exact setting of a throttle, which may alternatively control the dispensing of glue.

It is a particularly preferable feature of the present invention that the length of time between drops and/or the size of the drops can be varied as a function of the speed of the packaging sheet. For example, it is possible to apply a constant timing ratio and to change the cycle durations as a function of speed. Alternatively, the cycle durations may remain constant and the timing ratio may be changed. Of course, it may also be preferred to combine the above timing applications. It is merely necessary to that the timing provides the application of glue per unit of length of packaging sheet remains within a desired target framework.

Preferably, the spacing between the glue drops on the packaging sheet remains approximately constant, and may be, e.g., approximately zero. This produces a very uniform development of glue beads along the length of the packaging sheet, and the small spacings between the drops would normally be taken into account because the glue is generally flattened out when the packaging sheet is pressed against the material web roll, i.e., adjacent drops of glue may thus come into contact with one another. Further, it may be desired to strengthen certain areas along the glue beads and to have areas along the glue beads with weaker binding forces, as caused, for instance, by arranging drops in tandem. This arrangement facilitates the final packaging of the material web roll. If the spacing between drops has been set such that adjacent drops merely touch one another when the packaging is complete, the desired protection is provided due to an unbroken line of glue and the possibility of tearing up the packaging, i.e., shredding it, at low expenditure.

Preferably, the glue beads are provided or applied adjacent to the edges of the packaging sheet. Because the edges are glued, damage to the packaging sheet from objects, e.g., which might occur between individual packaging layers, is almost impossible. In addition, the encroachment of humidity is substantially halted in the vicinity directly adjacent to the edges of the packaging sheet.

In another preferable embodiment of the present invention, the end gluing device may provide a flat application of glue. Because the glue beads of the operational gluing device produce a substantially line-shaped application of glue, so that only a correspondingly small area is available for the adhesive force. Further, if a larger gluing area is selected, a greater adhesive force can be attained if conditions remain unchanged. Thus, even if the specific adhesive force, i.e., the adhesive force per unit area, in an application is not greater than the adhesive force of the glue beads, there is a considerably greater possibility that the glued joint with the material web roll may adequately hold for the packaging sheet to be wrapped around the roll.

A preferred embodiment of the present invention may be provided in that the end gluing device includes a glue spraying device. A glue spraying device may not only produces a flat application of glue, but, as a general rule, sprayed-on glue has a substantially higher immediate adhesive force than conventional glue beads. This enhanced adhesive force may be due to the fact that sprayed on glue has a lower water content. While the spraying of glue is generally known, it generally results in very rapid contamination of the operational gluing device and its surrounding area Because of these shortcomings, glue spraying devices are not generally preferred in these type applications. Further, necessary repairs to the glue spraying device make its use less economical. However, in accordance with the present invention, the glue spraying device is only utilized at the beginning and possibly at the end of the packaging sheet. In this manner, the operating time of the glue spraying device may be kept to a minimum. Accordingly, contamination resulting from the use of the glue spraying device may likewise be held to a corresponding minimum. While cleaning of the glue spraying device is nevertheless essential, by utilizing the glue spraying device in accordance with the present invention, the cleaning may be performed at greater intervals.

Preferably, the glue spraying device may substantially spray a width of the packaging sheet with glue. Thus, the application of glue may be limited to relatively short areas along the length. To keep contamination to a minimum, a certain distance to the edges of the packaging sheet should be maintained while spraying the glue. Accordingly, when the glue is sprayed at short intervals over a wide area, a high degree of initial firmness of glued joint can be achieved with little contamination of the device.

Accordingly, the present invention relates to a device for packaging a material web roll, having a longitudinal axis, with a packaging sheet. The device includes a packaging sheet dispenser that dispenses the packaging sheet such that a lateral width of the packaging sheet forms an acute angle to the longitudinal axis. The device also includes a glue application station having a first glue application device composed of an operational gluing device and a second glue application device composed as an end gluing device.

In accordance with another feature of the present invention, the operational gluing device may have an output that produces at least two glue beads running substantially parallel to edges of the packaging sheet.

In accordance with another feature of the present invention, the operational gluing device may be positioned to arranged the glue beads adjacent to the edges of the packaging sheet.

In accordance with still another feature of the present invention, the device may include a control device coupled to the glue application station. The control device may control the application of glue by the operational gluing device in accordance with a dispensing speed of the packaging sheet.

In accordance with a further feature of the present invention, the device may include a timing device supplying clock pulses. The operational gluing device may receive the clock pulses and dispense glue in the form of drops. Further, at least one of a time interval and a size of the drops may be variable in accordance with of a dispensing speed of the packaging sheet. Alternatively, the operational gluing device may dispense the drops of glue on the packaging sheet with an at least approximately constant spacing.

In accordance with a still further feature of the present invention, the end gluing device may have an output that produces a two-dimensional application of glue.

In accordance with another feature of the present invention, the end gluing device may include a glue spraying device. Further, the glue spraying device may have a nozzle that substantially sprays glue over a width of the packaging sheet.

The present invention may also be directed to a method for preparing a packaging sheet for helical wrapping around a rotating material web roll. The method includes feeding the packaging sheet through a gluing station, applying at least one glue bead parallel to an edge of the packaging sheet, spraying glue onto at least a portion of the packaging sheet, and guiding the packaging sheet onto an outer surface of the material web roll.

In accordance with another feature of the present invention, the applying of the at least one glue bead may include depositing a plurality of drops onto a surface of the packaging sheet in accordance with a feeding speed of the packaging sheet. Further, the at least one glue bead may include two edge glue beads, and the method may include applying the two edge glue beads adjacent opposite edges of the packaging sheet. Still further, the spraying of glue onto the at least a portion of the packaging sheet may include spraying a layer of glue between the two edge glue beads. The at least a portion of the packaging sheet may include a front edge and a rear edge of the packaging sheet.

In accordance with another feature of the present invention, the spraying of glue onto the at least a portion of the packaging sheet may include spraying a layer of glue along a limited longitudinal extent of the packaging sheet. Further, the limited longitudinal extent of the packaging sheet may include a front edge and a rear edge of the packaging sheet.

In accordance with a further feature of the present invention, the method including pressing the packaging sheet against the circumference of the material web roll. Further, the pressing of the packaging sheet may include forming a first nip between the material web roll and a first support roll, forming a second nip between the material web roll and a second support roll, and guiding the packaging sheet between the first and second nips. The first and second nips may be separated by a predetermined distance and a longitudinal extent of the at least a portion of the packaging sheet may be substantially the same as the predetermined distance.

In accordance with still another feature of the present invention, the method may include controlling the applying of the at least one glue bead in accordance with a rotational speed of the material web roll.

In accordance with yet another feature of the present invention, the applying of the at least one glue bead may include substantially evenly depositing drops of glue along a longitudinal extent of the packaging sheet. Further, the feeding of the packaging sheet may include variably adjusting a feed rate. The feed rate may be slower for the front and rear ends of the packaging sheet than for the portion of the packaging sheet between the front and rear ends.

Other exemplary embodiments and advantages of the present invention may be ascertained by reviewing the present disclosure and the accompanying drawing.

BRIEF DESCRIPTION OF THE DRAWINGS

The present invention may be further described in the detailed description which follows, in reference to the noted drawing by way of non-limiting example of a preferred embodiment of the present invention, and wherein:

FIG. 1 illustrates a schematic top view of a packaging sheet;

FIG. 2 illustrates a schematic top view of a packaging sheet after passing through a glue application station; and FIG. 3 illustrates a schematic front view of the glue application station.

DETAILED DESCRIPTION OF THE PRESENT INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing figure making apparent to those skilled in the art how the invention may be embodied in practice.

FIG. 1 illustrates a packaging device 1 for packaging a material web roll 2 with a packaging sheet 3. Material web roll 2 may be mounted on two support (carrier) rolls 4 and 5 and at least one, e.g., support roll 5, can be rotated by a motor. Thus, rotation of support roll 5 imparts rotation on material web roll 2.

Packaging sheet 3 may be wrapped onto a supply roll 7 which is positioned on a packaging sheet dispenser 8. Packaging sheet dispenser 8 may be positioned to slide on tracks 9 and 10, which are arranged parallel to material web roll 3. Further, packaging sheet dispenser 8 may be angularly and pivotably adjustable with respect to material web roll 2. In the angled position depicted in FIG. 1, a width of packaging sheet 3, i.e., the axial direction of supply roll 7, forms an acute angle with an axial direction of material web roll 2. If packaging sheet 3 is guided in this alignment between material web roll 2 and support roll 5, and attached onto material web roll 2, a helical packaging with packaging sheet 3 occurs when material web roll 2 rotates in the direction of arrow 11 (FIG. 3).

Packaging sheet 3 may have a substantially smaller width, e.g., between approximately 0.35 and 0.75 m, than the axial length of material web roll 2. Thus, to produce the packaging, a number of rotations of material web roll 2 are necessary. Obviously, this takes some time to complete, and the packaging time can assume some high values.

To prevent these excessive packaging times, material web roll 2 can be rotated at a higher rate of circumferential speed, e.g., 300 m/min. It is also desirable to achieve these speeds as soon as possible, e.g., within a few seconds. Thus, acceleration speeds should be correspondingly short, which leads to high accelerations with corresponding forces. Further, very little time is available for attaching packaging sheet 3 to material web roll 2.

In order to attach packaging sheet 3 to material web roll 2, a glue application station 12, schematically illustrated in FIGS. 1 and 3, is provided. In FIG. 3, packaging sheet 3 is shown at two discrete portions of the packaging device 1 for the purpose of clarity, i.e., from a front view being guided under glue application station 12 and form a lateral view being guided between material web roll 2 and support roll 5. However, packaging sheet 3 preferably runs in a straight line from glue application device 12 to material web roll 2.

Glue application station 12 may be provided with a carrier 13 that is positioned slightly above the portion of packaging sheet 3 unrolled from roll 7. This enables glue station 12 to apply glue to an upper side 14 of packaging sheet 3. Once glued, upper side 14 is guided toward material web roll 2 to contact the circumferential surface of the material web roll 2. As material web roll 2 rotates, upper side 14 may be pressed upward against material web roll 2 by support rolls 5 and 4.

Glue application station 12 may include a first operational gluing device 15, referred to as, e.g., an operational gluing device, and a second operational gluing device 16, referred to as, e.g., an end gluing device. The end gluing device derives is name from the fact that it applies glue to areas of packaging sheet 3 that are to be positioned at the axial ends 17 and 18 of material web roll 2.

Operational gluing devices 15 may be coupled to a supply container 21, e.g., via a supply line 19 and a pump 20. Pump 20 may take glue from supply container 21 and pressure-feed the glue through supply line 19. Operational gluing devices 15 may also be provided with valves 22 which may be selectively opened and closed, e.g., via a control device 23. In accordance with the position of valves 22, i.e., open or closed, glue is dispensed from operational gluing devices 15 in the form of drops 24. Control device 23 may be linked to driving apparatus 6 of support roll 5. In this manner, the control device 23 can regulate the opening and closing of valves 22 in accordance with the circumferential speed of material web roll 2 imparted by driving apparatus 6, and, therefore, the feeding speed of packaging sheet 3. Valves 22 may be controlled so that the application of glue varies periodically as a function of the speed of packaging sheet 3. Specifically, application of glue may be controlled so that it remains constant, or at least within a predetermined target range, per unit of length of the packaging sheet 3. This control may be achieved by control device 23 supplying valves 22 with clock pulses. For example, control device 23 may open valves 22 at periodically sequential intervals and, after every opening, reclose them. In this manner, the opening time, relative to the entire period length, i.e., a so-called "pulse-duty factor," may vary as a function of the feeding speed of packaging sheet 3. Of course, it is alternatively possible to vary the cycle durations so that timing ratio may remain constant, or to vary both. Accordingly, at the beginning of the wrapping procedure, i.e., when material web roll 2 rotates, and, correspondingly, packaging sheet 3 is fed, at a slow rate of speed, less glue may be dispensed or applied than during the later stages of wrapping, i.e., when material web roll 2 rotates at a higher rate of speed.

As shown in FIG. 2, operational gluing devices 15 produce glue beads 25 formed by a sequence of glue drops 24. Glue drops 24 may touch one another, e.g., when squeezed flat in the course of attaching packaging roll 3 onto material web roll 2. While this is advantageous, it is not necessary that glue drops 24 touch each other. While three glue beads 25 are shown in the exemplary illustration of FIG. 2, it is noted that more than three glue bead 25 may be utilized in accordance with the present invention. However, the present invention provides that two glue beads 25 may be located as close as possible to an edge of packaging sheet 3.

Second operational gluing device, i.e., the end gluing device 16, may be linked with or coupled to a supply container 28, e.g., via a supply line 26 and a pump 27. End gluing device 16 may include spray nozzles 29 coupled in series with a valve 30. Control device 23 may be coupled with end gluing device 16 to actuate valve 30. When valve 30 is opened a spray beam 31 may be formed and directed toward areas 32 on upper side 14 of packaging sheet 3.

As shown in FIG. 2, areas 32 are developed or prepared flat and extend over almost the entire width of packaging sheet 3. However, in order to avoid contaminating the surroundings, areas 32 are formed to maintain a certain distance to the edges. In contrast to the width, in the longitudinal direction or the direction of motion of packaging sheet 3, areas 32 are relatively short. That is, the longitudinal extent of areas 32 end just after a front edge 33 of packaging sheet 3. Accordingly, end gluing device 16 may only be utilized for a short period of time, which reduces contamination of the surrounding to a minimum.

Spraying the glue from supply container 28 out of spray nozzles 29 may produces a flat application of glue having a greater initial adhesive force. This greater initial adhesive force may be due to the reduced water content of the glue after spray application.

During attachment against material web roll 2, packaging sheet 3 may receive a high initial adhesive force as it passes through a first nip between support roll 5 and material web roll 2. This adhesion force may be further strengthened upon passing though a second nip formed between support roll 4 and material web roll 2. Essentially, the longitudinal extent of area 32 needs to be only as long as a distance between support rolls 4 and 5. However, in certain cases, area 32 can even be shorter.

At the beginning and the end of packaging sheet 3, end gluing device 16 is actuated as well as operational gluing device 15. However, because of the reduced rotational speed of material web roll 2 and the reduced feed rate of packaging sheet 3, a relatively small amount of glue is dispensed or applied per unit of time. Shortly after the beginning (or leading edge portion) of packaging sheet 3, spray application from end (or trailing edge portion) gluing device 16 ceases, and spray application for end gluing device 16 begins shortly before the end of packaging sheet 3. Along the entire longitudinal extent of packaging sheet 3, operational gluing device 15 produces glue beads 25. This application of glue beads 25 is adequate because, after a certain time, even glue beads 25 ensure the desired firm adhesion of individual layers of packaging sheet 3 to one another or to material web roll 2.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A device for packaging a web roll having a longitudinal axis with a packaging sheet comprising:

a packaging sheet dispenser that dispenses the packaging sheet such that a lateral width of the packaging sheet forms an acute angle to the longitudinal axis; and a glue application station comprising a first glue application device composed of an operational gluing device and a second glue application device composed of an end gluing device, which is adapted to supply glue having a higher initial adhesion than glue supplied by the operational gluing device.

2. The device in accordance with claim 1, the operational gluing device having an output that produces at least two glue beads running substantially parallel to edges of the packaging sheet.

3. The device in accordance with claim 2, the operational gluing device is positioned to arranged the glue beads adjacent to the edges of the packaging sheet.

4. The device in accordance with claim 1, further comprising a control device coupled to the glue application station, the control device controlling the application of glue by the operational gluing device in accordance with a dispensing speed of the packaging sheet.

5. The device in accordance with claim 1, the end gluing device having an output that produces a two-dimensional application of glue.

6. The device in accordance with claim 1, the end gluing device comprising a glue spraying device.

7. The device in accordance with claim 6, the glue spraying device having a nozzle that substantially sprays glue over a width of the packaging sheet.

8. A method for preparing a packaging sheet for helical wrapping around a rotating material web roll, the method comprising:

feeding the packaging sheet through a gluing station;

applying at least one glue bead parallel to an edge of the packaging sheet;

spraying glue having a higher initial adhesion than glue of the at least one glue bead onto at least a portion of the packaging sheet; and guiding the packaging sheet onto an outer surface of the material web roll.

9. The method in accordance with claim 8, the applying of the at least one glue bead comprising:

depositing a plurality of drops onto a surface of the packaging sheet in accordance with a feeding speed of the packaging sheet.

10. The method in accordance with claim 9, the at least one glue bead comprising two edge glue beads, and the method further comprising:

applying the two edge glue beads adjacent opposite edges of the packaging sheet.

11. The method in accordance with claim 10, the spraying of glue onto the at least a portion of the packaging sheet comprising:

spraying a layer of glue between the two edge glue beads.

12. The method in accordance with claim 11, the at least a portion of the packaging sheet comprising a front edge and a rear edge of the packaging sheet.

13. The method in accordance with claim 8, the spraying of glue onto the at least a portion of the packaging sheet comprising:

spraying a layer of glue along a limited longitudinal extent of the packaging sheet.

14. The method in accordance with claim 13, the limited longitudinal extent of the packaging sheet comprising a front edge and a rear edge of the packaging sheet.

15. The method in accordance with claim 8, further comprising:

pressing the packaging sheet against the circumference of the material web roll.

16. The method in accordance with claim 15, the pressing of the packaging sheet comprising:

forming a first nip between the material web roll and a first support roll;

forming a second nip between the material web roll and a second support roll; and guiding the packaging sheet between the first and second nips.

17. The method in accordance with claim 16, wherein the first and second nip are separated by a predetermined distance, and wherein a longitudinal extent of the at least a portion of the packaging sheet is substantially the same as the predetermined distance.

18. The method in accordance with claim 8, further comprising:

controlling the applying of the at least one glue bead in accordance with a rotational speed of the material web roll.

19. The method in accordance with claim 8, the applying of the at least one glue bead comprising substantially evenly depositing drops of glue along a longitudinal extent of the packaging sheet.

20. The method in accordance with claim 19, the feeding of the packaging sheet comprising variably adjusting a feed rate.

21. The method in accordance with claim 20, wherein the feed rate is slower for the front and rear ends of the packaging sheet than for the portion of the packaging sheet between the front and rear ends.

22. The device in accordance with claim 1, wherein the end gluing device is actuatable at both ends of the material web roll.

23. The method in accordance with claim 8, the spraying of the glue onto at least a portion of the packaging sheet comprising spraying the glue onto a leading edge portion and a trailing edge portion of the packaging sheet.

24. The method in accordance with claim 23, further comprising disabling the spraying of the glue between the leading edge portion and the trailing edge portion.

25. A device for packaging a web roll having a longitudinal axis with a packaging sheet comprising:

a packaging sheet dispenser that dispenses the packaging sheet such that a lateral width of the packaging sheet forms an acute angle to the longitudinal axis;

a glue application station comprising a first glue application device composed of an operational gluing device and a second glue application device composed of an end gluing device;

a timing device supplying clock pulses; and the operational gluing device receiving the clock pulses and dispensing glue in the form of drops in response to the receipt of the clock pulses.

26. The device in accordance with claim 25, wherein at least one of a time interval and a size of the drops is variable in accordance with of a dispensing speed of the packaging sheet.

27. The device in accordance with claim 25, the operational gluing device dispensing the drops of glue on the packaging sheet with an at least approximately constant spacing.

* * * * *